US006685172B2

(12) United States Patent
Jolliffe

(10) Patent No.: US 6,685,172 B2
(45) Date of Patent: Feb. 3, 2004

(54) LAMINATED PLASTIC BARRIER FENCE

(76) Inventor: Wayne Herbert Jolliffe, 54 Redwood Lane, London, Ontario (CA), N5V 4C2

( * ) Notice: Subject to any disclaimer, the term of this patent is extended or adjusted under 35 U.S.C. 154(b) by 0 days.

(21) Appl. No.: 09/789,308

(22) Filed: Feb. 21, 2001

(65) Prior Publication Data

US 2001/0033911 A1 Oct. 25, 2001

Related U.S. Application Data

(60) Provisional application No. 60/183,801, filed on Feb. 22, 2000.

(51) Int. Cl.[7] ..... E04H 17/16

(52) U.S. Cl. ..... 256/24; 256/19; 256/25; 40/615

(58) Field of Search ..... 256/1, 19, 24–26; 446/476–478, 487–488; 40/124–191, 615

(56) References Cited

U.S. PATENT DOCUMENTS

| | | | | | |
|---|---|---|---|---|---|
| 3,735,536 | A | * | 5/1973 | Bellasalma | |
| 3,883,120 | A | * | 5/1975 | Tippmann | 256/24 |
| 4,526,405 | A | | 7/1985 | Hattemer | |
| 4,673,609 | A | * | 6/1987 | Hill | |
| 4,787,601 | A | | 11/1988 | Rybak | |
| 4,937,962 | A | * | 7/1990 | Hornblad | 40/617 |
| 4,982,929 | A | | 1/1991 | Spurling | |
| 5,265,848 | A | * | 11/1993 | Michaud et al. | 256/26 |
| 5,402,988 | A | * | 4/1995 | Eisele | 256/24 |
| 5,552,165 | A | | 9/1996 | Haak et al. | |
| 5,865,427 | A | * | 2/1999 | Cowan | 256/19 |
| D435,669 | S | * | 12/2000 | Kieffer | |

FOREIGN PATENT DOCUMENTS

| | | |
|---|---|---|
| CA | 2254190 | 5/1999 |

* cited by examiner

*Primary Examiner*—Lynne H. Browne
*Assistant Examiner*—Michael P. Ferguson
(74) *Attorney, Agent, or Firm*—Anissimoff & Assoc.; Hans Koenig

(57) ABSTRACT

A laminated plastic barrier type fence encapsulates a printed message or sign. The plastic fence is laminated. A message or sign which is printed on a portion of one side of a first sheet of plastic sheeting material. The first sheet is then laminated to a second sheet of plastic sheeting material. A regular array of apertures is made in the laminated sheet to either side of the printing.

17 Claims, 1 Drawing Sheet

LAMINATED PLASTIC BARRIER FENCE

This application claims the benefit of U.S. provisional application U.S. Ser. No. 60/183,801 filed Feb. 22, 2000.

BACKGROUND OF THE INVENTION

The invention relates to improvements in a plastic barrier type fence and a method of making such a fence. In another embodiment, the invention relates to a laminated plastic barrier type fence which physically incorporates and displays a message or sign comprising text, graphics, pictures or the like.

Plastic barrier type fencing is known and is typically used, by way of example, in the vicinity of construction sites or sporting events to demark protected or designated areas from ingress by members of the public. The plastic fencing may be manufactured from a number of different UV stabilized engineered polymers including, for example, high density polyethylene. The fencing is typically manufactured in thousand foot lengths and various heights, and may be made in any color. The fencing is available in rolls making it highly portable and easy to install. This type of fencing functions extremely well as a physical and visible barrier to control and direct crowds.

One disadvantage associated with plastic barrier type fencing is the difficulty of attaching a message or sign to the plastic fence. The presentation of printed subject matter on a plastic fence is considered highly desirable in terms of increasing its utility and versatility. While it is obvious, for example, to attach a banner or the like bearing a message to the plastic fence by means of ties, this is not very satisfactory from either a functional or esthetic point of view. The banner attached in the manner aforesaid never appears to be properly displayed and is susceptible of being torn and damaged during installation, use or storage.

One inherent problem with this type of fencing is the so-called "sail effect" meaning that the action of the wind places an aerodynamic load on the fence tending to dislodge it from its moorings or attachments on the ground. The fact that plastic fencing is provided with a regular array of apertures or perforations minimizes this effect. However, a banner bearing the message or sign cannot be provided with a regular array of apertures without in effect destroying the presentation. Accordingly, the use of solid banners increases and multiplies the "sail effect" to the detriment of both the fence and the fence installation. Another disadvantage of attaching banners to a plastic fence in the manner described is that, the banner cannot be re-used after storage as roll-up storage of the fence may damage the banner.

It is an object of the present invention to provide a method of manufacturing a plastic fence having printed subject matter comprising at least the following steps. A first step of printing a message or sign on one side of a first sheet of plastic sheeting material. A second step of laminating the first sheet of plastic sheeting material to a second sheet of plastic sheeting material. A third step of cutting an array of apertures in the laminated sheet to either side of the printed message or sign.

SUMMARY OF THE INVENTION

With the forgoing in mind it is a principal object of this invention to provide a portable, highly visible, re-useable, high strength, UV stabilized, plastic barrier type fence which physically incorporates a printed message or sign of any kind or description. The prime utility or feature of the fence according to this invention is the improved ability to display a message or sign to the general public in the vicinity of the fence. The invention does not actively concern itself with the actual strength of the fence in terms of its ability to physically restrain a person or crowd.

DETAILED DESCRIPTION OF THE PREFERRED EMBODIMENT

Figure 1:
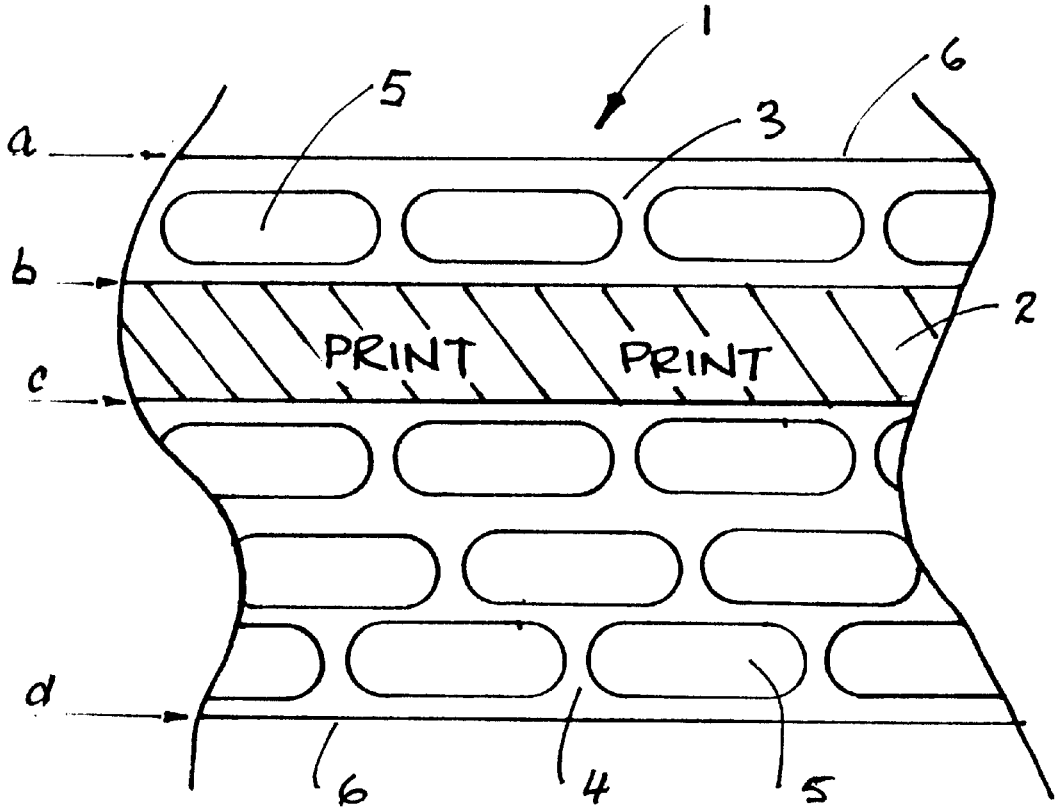
FIG. 1 is a side view of a section of plastic fence made according to this invention.

Referring in general to the drawings and initially to FIG. 1, a typical section of plastic fence made according to this invention is shown. The fence (1) consists of a laminated plastic sheet having a solid bandwidth region (2) having a width bc within the confines of which the message or sign is displayed which is indicated in the Figure and by way of example, using the word PRINT. The remainder of fence to either side of the bandwidth portion 2 is comprised of perforated or apertured regions 3 and 4 having widths ab and cd respectively. The perforations or apertures 5 are those typically made in plastic fencing and are made in any repeating pattern. A preferred method of manufacturing the plastic fence according to this invention incorporating a message or sign is now described.

Firstly, the message or sign intended for display is printed on thin transparent plastic sheeting material using known methods of printing which will be hereinafter referred to as the exterior sheet. Typically, such sheeting material is manufactured in rolls having different thicknesses and widths. In accordance with one embodiment, a roll of plastic sheeting material having an approximate thickness of 3 to 4 mils and an approximate width of 48 inches is used for printing. As explained, although the message or sign may be printed anywhere on the exterior sheet, it is preferably printed within the confines of the bandwidth 2 leaving the remainder of the exterior sheet transparent.

The printed message or sign typically consists of text, graphics, solid colors or the like all of which subject matter is intended to be brought to the attention of the general public in the vicinity of the fence. In certain circumstances, a message or sign need not be printed on the exterior sheet and may instead consist of any particular distinctive feature inherent to the exterior sheet. For example, the exterior sheet may consist of a thin sheet of Milar® reflective film and its use in the manner hereinafter described will give the fence reflective properties.

It is also important to have regard to the manner in which the message or sign is printed on one of the sides of the exterior sheet. If for example, it is desired to encapsulate the printed subject matter within the fence, the subject matter must be reversed printed on one side of the exterior sheet so that it may only be correctly understood and read when viewed from the other side of the sheet. According to this aspect of the invention, the side of the exterior sheet on which the message or sign has been printed will be laminated as hereinafter described with the consequence that the print will be protected by the width of the exterior sheet overlying the message or sign.

The bandwidth for the printed subject matter is preferably between 12 and 16 inches and may be positioned anywhere between the width extremities 6 of the exterior sheet as preference suits. Usually, the printed message will be located near the top of the fence so as to be more visible to the general public. Because the exterior sheet is transparent, the reverse printed subject matter on one side thereof may be viewed and correctly understood by looking through the other side of the sheet. In this way, having regard to the lamination steps hereinafter described, the print is encapsulated and protected from damage or scratching by means of a plastic covering. The message or sign, of course, need not be reverse printing on the exterior sheet for encapsulation in all cases to obtain the benefits of the invention.

Figure 2:
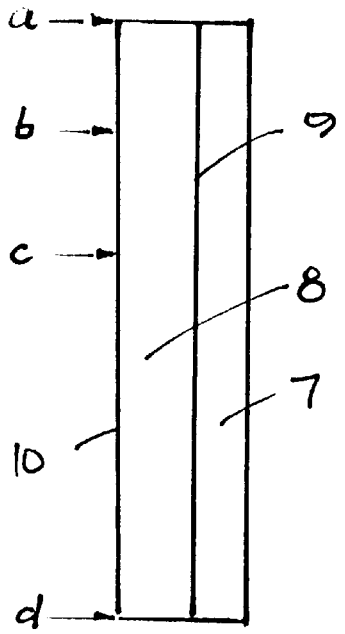
FIG. 2 is a laminated cross-section of one embodiment of the plastic fence.

Following the printing step, the exterior sheet is now laminated to a second preferably thicker backing sheet (8) of plastic sheeting material. Referring to FIG. 2, the exterior sheet 7 is laminated to the backing sheet 8 which is also approximately 48 inches in width and approximately 8 to 10 mil in thickness. In the embodiment shown, it can be seen that the side 9 of the exterior sheet 7 on which the subject matter has been printed is laminated to one side of the backing sheet. In this way, the printed subject matter is encapsulated within the plastic sheets and protected from damage on both sides by the width of the layers of the plastic sheeting material. Since the backing sheet is not transparent, the message or sign in the embodiment shown will be visible to only one side of the fence and may be correctly understood by virtue of having been reversed printed as described.

The lamination process employed is one involving the application of adhesive to one or both surfaces of the sheets being laminated. The final lamination step is completed by means of the application of heat and pressure in the usual way. This lamination step produces the laminated fence material having a thickness of approximately 14 to 18 mils having the message or sign in encapsulated therein.

Figure 3:
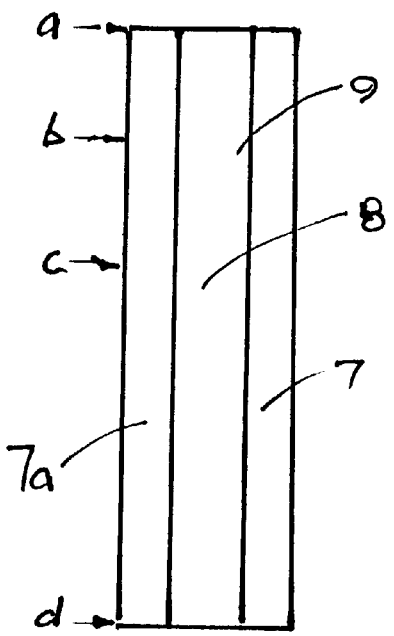
FIG. 3 is another laminated cross-section of another embodiment of the plastic fence.

In yet another embodiment of the invention shown in FIG. 3, a further lamination step is performed wherein a second exterior sheet 7(*a*) prepared identically to the first mentioned exterior sheet 7 is laminated to the other side of the backing sheet 8 in the same identical way. This lamination variation produces a fence having a visible message or sign which is visible on either side of the fence. Yet a further variation of the invention may include laminating the laminated sheet shown in FIG. 2 to one identical to it along surface 10 resulting in thicker and stronger fence with a visible sign or message sign on each side thereof.

The lamination step or steps described above may result in flaws in adhesion in the vicinity of the outside edges of the laminated sheets. A standard trimming step may be required to eliminate these flaws.

The final step in the manufacturing process involves providing the plastic fence with the appearance and functionality of a fence by providing the laminated sheet with apertures or perforations (5) on either side of the bandwidth bc bearing the printed subject matter. This is also preferable from the point of view of minimizing the sail effect. The apertures are formed by passing the laminated sheet(s) through a die cutting machine where the cutting dies are aligned and positioned with reference to the laminated sheet to either side of the bandwidth bc. The laminated sheets are then fed or indexed through the die cutting machine to make the apertures. Any type or arrangement of apertures may be provided bearing in mind that the objective is one of maximizing the size of the apertures without sacrificing the strength of the fence material. The plastic material removed by the die may be recycled and used, for example, to make plastic posts to which the fence may be attached as described hereinafter.

The fence made according to this invention may be erected using T-posts inserted and fixed in the ground. The T-post has a flat side against which the plastic fence material is placed in abutment. Thereafter, a wood slat is placed and aligned on the opposite side of the flat portion of the T-bar sandwiching the barrier fence therebetween. Ties or plastic cables can be used to secure the slat to the T-post thereby securing the fence. To connect adjacent fencing sections at their ends, the fence portions may be overlapped and a wooden slat weaved through the apertures in the fence. These methods of attaching the barrier fence will work extremely well for the purpose of equivalent alternations and modifications, and is limited only by the scope of the claims.

From the forgoing, it will be seen that this invention is one well adapted to attain all the ends and objects hereinabove set forth together with other advantages which are obvious and which are inherent to the structure.

Since many possible embodiments may be made of the invention without departing from the scope of the thereof, it is to be understood that all matter herein set forth or shown in the accompanying drawings is to be interpreted as illustrative and not in a limiting sense.

Although the invention has been shown and described with respect to certain preferred embodiments, it is obvious that the equivalent alterations and modifications will occur to others skilled in the art upon the reading and understanding of the specification. The present invention includes all such equivalent alternations and modifications, and is limited only by the scope of the claims.

What is claimed is:

1. A flexible laminated plastic fence comprising a laminate of at least two sheets of flexible plastic sheeting material having apertures therethrough for reducing sailing effect, at least one of the sheets being transparent and having printed subject matter thereon, the printed subject matter being encapsulated between the at least two sheets and displayed within a solid bandwidth region not having the apertures therethrough, and at least one of the sheets not being transparent.

2. The fence according to claim 1, wherein the fence comprises a laminate of two sheets of flexible plastic sheeting material.

3. The fence according to claim 1, wherein the printed subject matter is a message or sign.

4. The fence according to claim 2, wherein the printed subject matter is a message or sign.

5. A flexible laminated plastic fence comprising a laminate of three sheets of flexible plastic sheeting material having apertures therethrough for reducing sailing effect, two of the sheets being exterior sheets, one sheet being a backing sheet between the exterior sheets, at least one of the exterior sheets having printed subject matter thereon, the printed subject matter being encapsulated between the at least one exterior sheet and backing sheet and displayed within a solid bandwidth region not having the apertures therethrough.

6. The fence according to claim 5, wherein the exterior sheets are transparent.

7. The fence according to claim 6, wherein both of the exterior sheets have printed subject matter thereon.

8. The fence according to claim 5, wherein the backing sheet is not transparent.

9. The fence according to claim 6, wherein the backing sheet is not transparent.

10. The fence according to claim 7, wherein the backing sheet is not transparent.

11. The fence according to claim 8, wherein the printed subject matter is a message or sign.

12. The fence according to claim 9, wherein the printed subject matter is a message or sign.

13. The fence according to claim 10, wherein the printed subject matter a message or sign.

14. A method of making a flexible laminated plastic fence, the method comprising the steps of:

(a) printing subject matter in a region of one side of a transparent first sheet of flexible plastic sheeting material;

(b) heat laminating the transparent first sheet to a second sheet of flexible plastic sheeting material to form a laminate having the printed subject matter encapsulated between the transparent first sheet and the second sheet; and, (c) cutting an array of apertures through the laminate such that the printed subject matter is displayed within a solid bandwidth region not having apertures therethrough.

15. The method according to claim 14, wherein a transparent third sheet of flexible plastic sheeting material having printed subject matter thereon is heat laminated to the second sheet.

16. The method according to claim 14, wherein the second sheet is not transparent.

17. The method according to claim 15, wherein the second sheet is not transparent.

* * * * *